US006517316B1

(12) United States Patent
Gajewski

(10) Patent No.: US 6,517,316 B1
(45) Date of Patent: Feb. 11, 2003

(54) CEILING FAN HOUSING ASSEMBLY

(75) Inventor: Mark Gajewski, Culver, CA (US)

(73) Assignee: Minka Lighting, Inc., Corona, CA (US)

( * ) Notice: Subject to any disclaimer, the term of this patent is extended or adjusted under 35 U.S.C. 154(b) by 0 days.

(21) Appl. No.: 10/003,450

(22) Filed: Oct. 23, 2001

Related U.S. Application Data

(62) Division of application No. 09/476,637, filed on Dec. 31, 1999, which is a division of application No. 29/104,917, filed on May 1, 1999, now Pat. No. Des. 426,630.

(51) Int. Cl.[7] ..... F04D 29/00

(52) U.S. Cl. ..... 416/5; 416/247 R; 416/244 R; 415/121.2; 415/213.1

(58) Field of Search ..... 415/121.2, 213.1, 415/214.1; 416/5, 210 R, 247 R, 244 R

(56) References Cited

U.S. PATENT DOCUMENTS

| | | | | | |
|---|---|---|---|---|---|
| D133,120 | S | | 7/1942 | Spear | |
| 3,261,544 | A | | 7/1966 | Guichard | 416/247 R |
| 3,294,977 | A | * | 12/1966 | Duncan | 416/5 |
| D262,736 | S | | 1/1982 | Wooden | D23/165 |
| 4,518,314 | A | | 5/1985 | Schultz | 416/93 R |
| 4,657,485 | A | | 4/1987 | Hartwig | 416/247 R |
| 4,884,947 | A | | 12/1989 | Rezek | 416/5 |
| 5,151,011 | A | | 9/1992 | Rezek | 416/5 |
| 5,222,864 | A | | 6/1993 | Pearce | 416/5 |
| 5,601,412 | A | | 2/1997 | Vice | 416/247 R |
| 5,645,403 | A | | 7/1997 | Bogage | 416/235 |
| 5,658,129 | A | | 8/1997 | Pearce | 416/5 |
| 5,899,663 | A | | 5/1999 | Feder et al. | 416/5 |
| 5,988,580 | A | * | 11/1999 | Bucher et al. | 248/343 |
| D426,630 | S | | 6/2000 | Gajewski | D23/377 |
| D426,879 | S | | 6/2000 | Gajewski | D23/411 |
| D434,845 | S | | 12/2000 | Gajewski | D23/413 |
| 6,200,099 | B1 | * | 3/2001 | Liao | 248/343 |
| 6,240,247 | B1 | * | 5/2001 | Reiker | 392/364 |
| 6,354,801 | B1 | * | 3/2002 | Gajewski | 416/5 |

* cited by examiner

*Primary Examiner*—Edward K. Look
*Assistant Examiner*—Ninh Nguyen
(74) *Attorney, Agent, or Firm*—Jenkens & Gilchrist, P.C.

(57) ABSTRACT

A ceiling fan having a down rod assembly, a motor, fan blades, an upper body, a hub assembly, and a cage. The cage provides an open enclosure for protecting the motor. The hub includes a hub canister and a hub cover. A lighting kit includes a lighting fixture within the hub canister and a lighting cover that is interchangeable with the hub cover.

36 Claims, 4 Drawing Sheets

CEILING FAN HOUSING ASSEMBLY

RELATED APPLICATIONS

This application is a divisional of application Ser. No. 09/476,637, filed Dec. 31, 1999, which is a divisional of U.S. patent application Ser. No. 29/104,917, filed May 1, 1999 now issued as U.S. Pat. No. D 426,630.

BACKGROUND

The present invention relates to ceiling fans.

A typical ceiling fan will include a down rod assembly suspended from the ceiling, a motor having a motor shaft connected to a lower portion of the down rod assembly and a motor body which rotates about the motor shaft, a motor housing secured to either the motor shaft or the down rod assembly which is stationary and surrounds the motor, blade mounting arms which are connect to the motor body and extend out of an opening of the motor housing or below the motor housing, and a hub attached to the motor shaft below the fan blades and fan blade arms.

Because the motor housing of a typical ceiling fan encloses the motor, the motor housing must have various openings to allow the escape of heat from the motor. However, the openings in the motor housing complicate the design of the motor housing and may limit the escape of heat from the motor because of the limited availability of the apertures in the motor housing. Therefore, there is a need for a motor housing that will provide the motor with better heat transfer than a typical motor housing.

Many ceiling fans include lighting fixtures which are incorporated into the hub. However, end users may want the versatility of changing between the option of not having a lighting fixture, or the option of having a lighting fixture. Therefore, there is a need for a ceiling fan with the ability to quickly change between the option of having a lighting fixture, and the option of not having a lighting fixture.

SUMMARY

In one embodiment, the present invention comprises a ceiling fan having a motor connected to a plurality of fan blades, a cage surrounding the motor with a fan blade opening, wherein the fan blades extend outwardly through the fan blade opening and the fan blade opening provides clearance for the fan blades to rotate without contacting the cage. In a further embodiment, the cage is a wire cage.

In another embodiment, the present invention comprises a ceiling fan having a motor with a motor shaft, a hub canister containing a lighting fixture, and a detachable hub cover and a detachable light cover, wherein the detachable hub cover and light cover are interchangeable covers for the hub canister. In a further embodiment, the invention further includes hub light electrical leads with hub light electrical connectors, and the light fixture further includes fixture electrical leads with fixture electrical connectors that mate with the hub light electrical connectors. In another further embodiment, the hub canister further includes hub protrusions and the hub cover and the lighting cover further include channels to receive the hub protrusions, thereby securing the respective hub cover or light cover to the hub canister.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
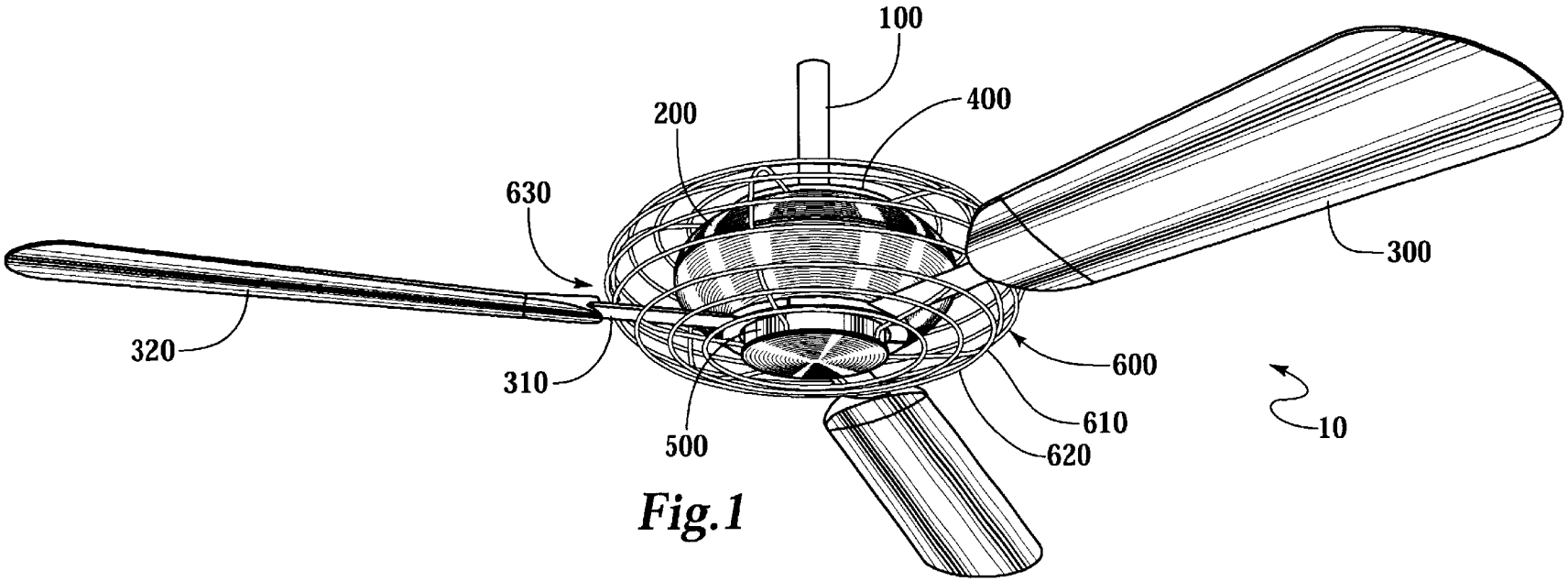
FIG. 1 shows a perspective view of one embodiment of the present invention, illustrated as a ceiling fan.
Figure 2:
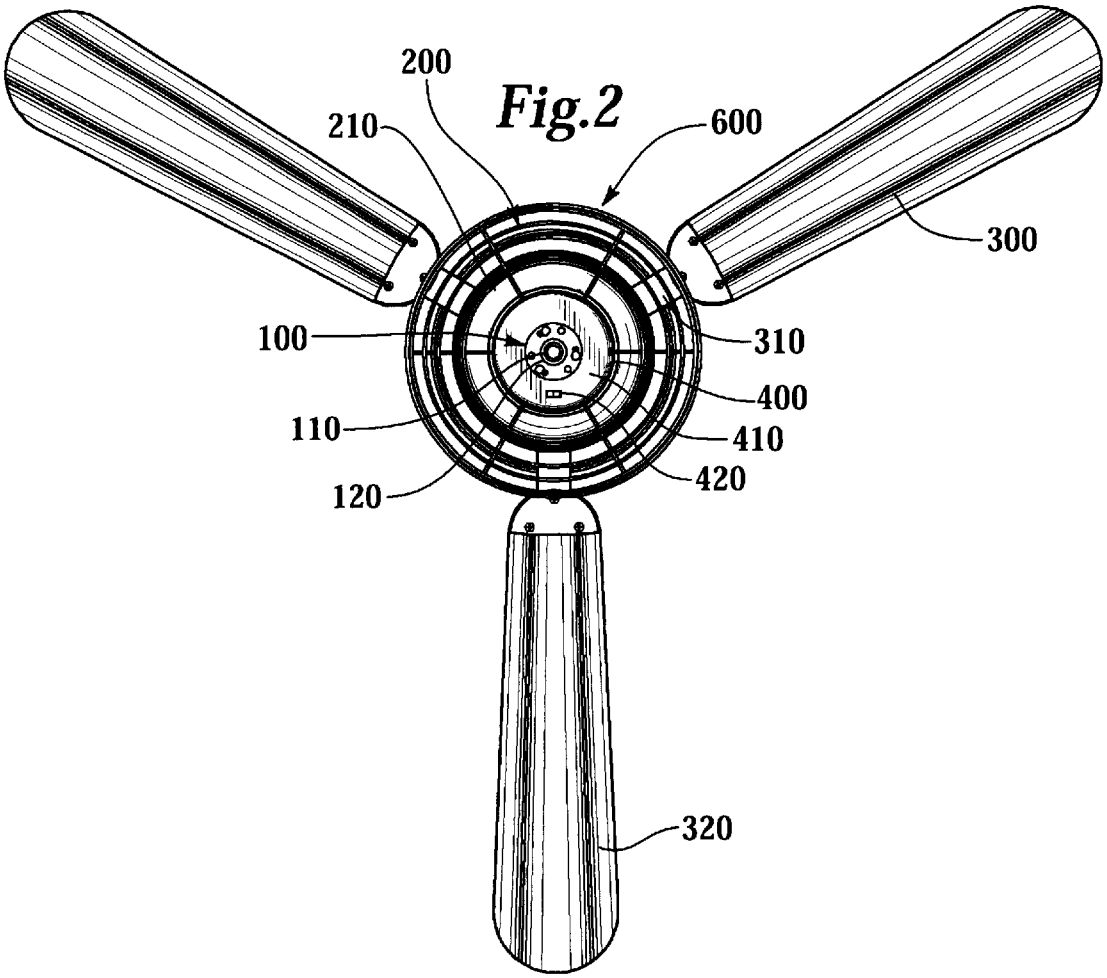
FIG. 2 shows a top plan view of the ceiling fan from FIG. 1.
Figure 3:
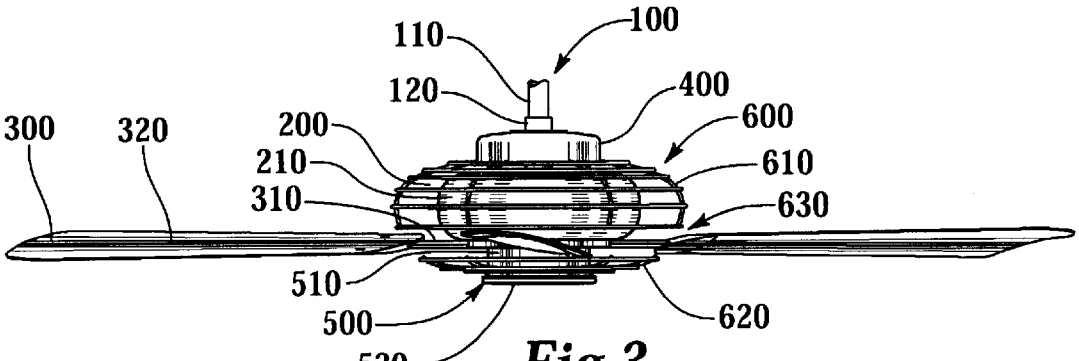
FIG. 3 shows a side elevational view of the ceiling fan from FIG. 1.
Figure 4:
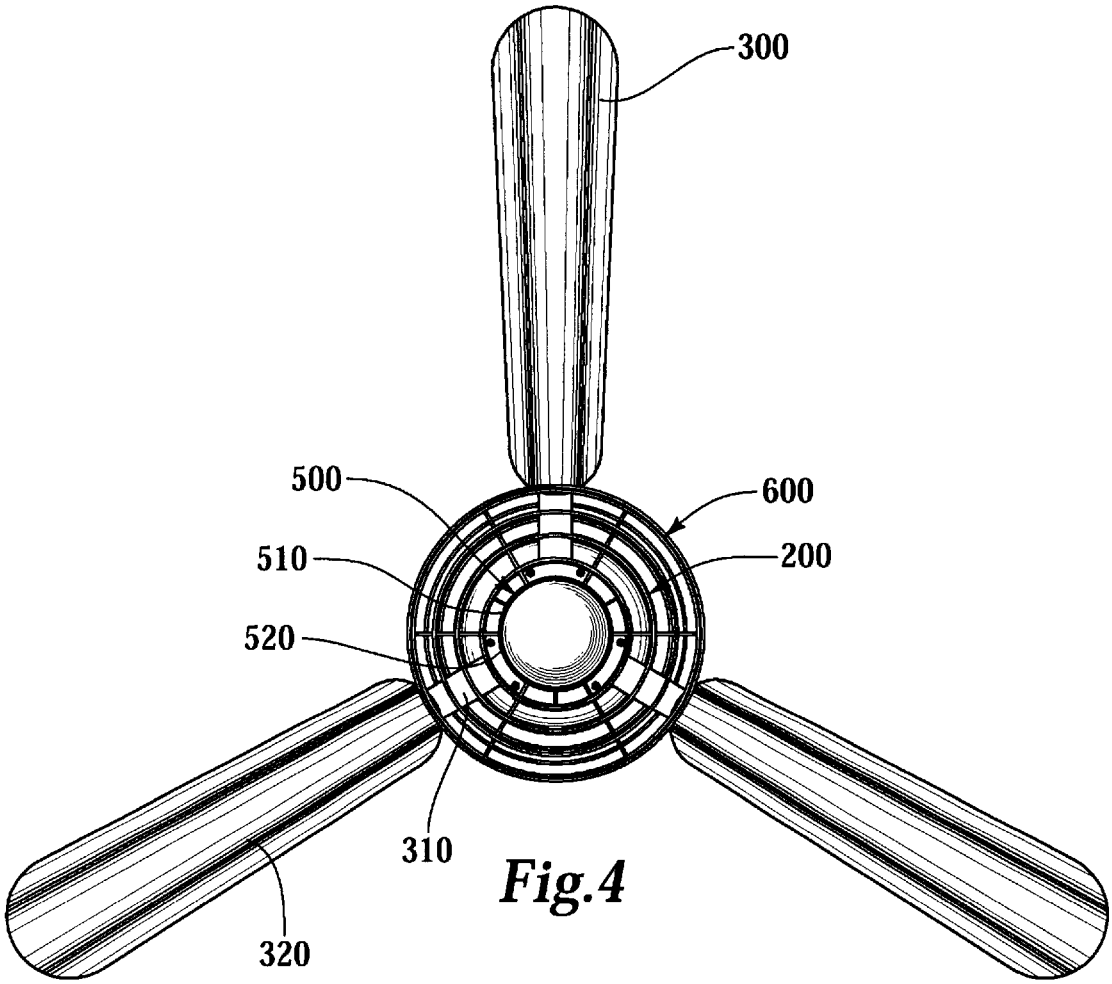
FIG. 4 shows a bottom plan view of the ceiling fan from FIG. 1.
Figure 5:
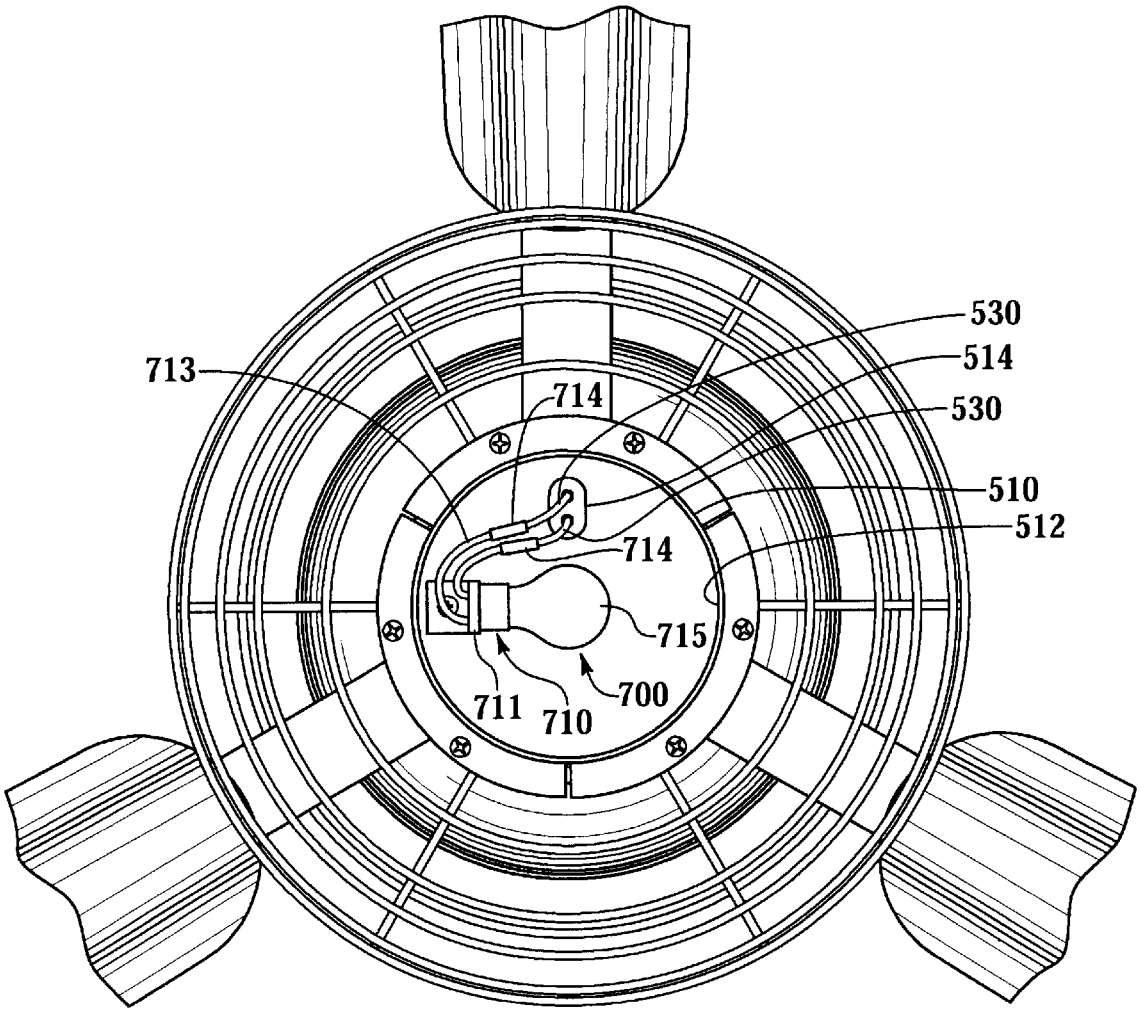
FIG. 5 shows an enlarged partial bottom plan view of the ceiling fan from FIG. 1, with a hub cover removed to illustrate a portion of a lighting kit; and, FIG. 6 shows a side elevational view of the ceiling fan from FIG. 1, illustrating the alternate embodiments with a hub cover or a lighting cover.
Figure 6:
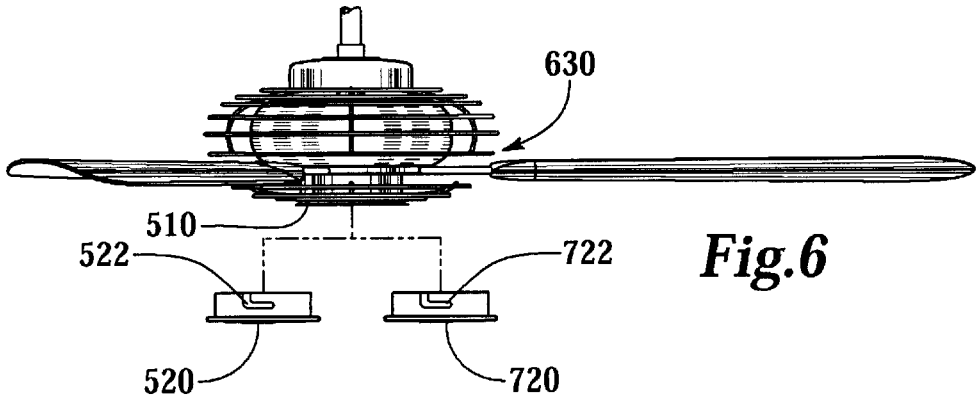

Referring now to the figures, there is shown an embodiment of the present invention illustrated in the ceiling fan 10. The ceiling fan 10 generally includes a down rod assembly 100, a motor 200, fan blades 300, an upper body 400, a hub assembly 500, and a cage 600.

The down rod assembly 100 includes a down rod 110 secured at one end to the location that the ceiling fan 10 depends from, and secured at a second end to a down rod mounting flange 120. The down rod mounting flange 120 is secured to the shaft (not shown) of the motor 200. Electrical wires for powering and controlling the ceiling fan 10 pass through the down rod 110 to the motor 200.

The upper body 400 is secured to the down rod mounting flange 120. A direction switch 410 is disposed on the upper body 400. The electrical powering and control of the ceiling fan 10 is well known in the art; therefore, in the interest of brevity, are not explained in detail here.

The fan blades 300 include a fan blade body 320 which is secured to a fan blade arm 310. The fan blade arms 310 are secured to a motor body 210 of the motor 200. In the embodiment illustrated, there are three fan blades 300. However, it is to be understood that any number of fan blades 300 could be used in the ceiling fan 10.

A hub body 510 or cannister of the hub assembly 500 is secured to the lower half of the shaft (not shown) of the motor 200, the down rod mounting flange 120, or both. The hub body 510 includes cover mounting protrusions 512 extending inwardly from the hub body 510. The hub cover 520 includes hub cover mounting passages 522 in the sides of the hub cover 520 for engaging the cover mounting protrusions 512 in the hub body 510, thereby securing the hub cover 520 to the hub body 510 in a detachable manner.

The cage 600 includes an upper cage section 610 and a lower cage section 620. The upper cage section 610 is secured to the upper body 400 and depends downwardly therefrom. The lower cage section 620 is secured to the hub body 510 and extends upwardly therefrom. A cage fan blade opening 630 exists between the upper cage section 610 and the lower cage section 620 for the fan blades 300 to extend outwardly through. As illustrated, the upper cage section 610 and the lower cage section 620 are formed of a wire material to maximizing the openness of the cage 600 while maintaining protection of the motor 200. In this manner, the cage 600 protects the motor 200 without placing restrictions on the fan blades or inhibiting the transfer of heat from the motor 200 via radiation and convection.

In one embodiment of the present invention, the ceiling fan 10 includes a lighting kit 700. The lighting kit 700 has a lighting fixture 710 and a light cover 720. The lighting fixture 710 includes a lighting socket 711 which is mounted inside the hub body 510 by a socket bracket 712. Fixture electrical socket leads 713 from the light socket 711 have fixture electrical connectors 714 for connection of the lighting kit. Hub light electrical leads 530 extend through an electrical lead opening 514 in the hub body 510, and have hub light electrical connectors 534 for connection with the fixture electrical connectors 714. A light bulb 715 is disposed in the light socket 711. A light cover 720 is either transparent or translucent is used in place of the hub cover 520 for the lighting kit 700. The electrical leads for supplying the lighting fixture 710 pass through the down rod 110 and the motor shaft (not shown) in a manner that is commonly known to a person of ordinary skill in the art. Light cover mounting passages 722 in the sidewalls of the light cover 720 engage the cover mounting protrusions 512 in the hub body 510 for securing the light cover 720 to the hub body 510 in a detachable manner. By supplying the ceiling fan 10 with the lighting kit 700, a user can decide between a non-lighted fixture and a lighted fixture by deciding on using the hub cover 520, or connecting the socket electrical connectors 714 to the hub light electrical connectors 534 and using the light cover 720 in place of the hub cover 520.

It is thus believed that the operation and construction of the present invention will be apparent from the foregoing description of a preferred embodiment. While the device and method shown are described as being preferred, it will be obvious to a person of ordinary skill in the art that various changes and modifications may be made therein without departing from the spirit and scope of the invention, as defined in the following claims. Therefore, the spirit and scope of the appended claims should not be limited to the description of the preferred embodiments contained herein.

What is claimed is:

1. A ceiling fan kit having a motor with a motor shaft, further including a hub canister containing a lighting fixture, a detachable hub cover and an at least translucent detachable light cover, wherein said detachable hub cover and said detachable light cover are interchangeable covers for said hub canister, wherein said hub canister further includes hub protrusions, and wherein said hub cover and said lighting cover further include channels in a sidewall of said hub cover to receive the hub protrusions, thereby securing the respective hub cover or light cover to said hub canister.

2. A ceiling fan kit comprising:

a downrod adapted to be suspended from a ceiling;

a motor adapted to be supported by said downrod;

a plurality of fan blades adapted to be rotated by said motor;

a hub body adapted to be affixed to said downrod below said motor and said plurality of fan blades, said hub body having a downward facing opening;

a light socket for optionally receiving a light source located within said downward facing opening of said hub body; and a detachable cover adapted to attach to the hub body and an at least translucent detachable light cover adapted to attach to the hub body, wherein said detachable hub cover and said detachable light cover are interchangeable covers for said downward facing opening of said hub body, whereby an end user may select one of the covers to be attached to the hub body.

3. The ceiling fan kit according to claim 2 wherein:

the hub body comprises cover mounting protrusions on a sidewall of said hub body; and each of the detachable hub cover and detachable light cover comprise hub cover mounting passages located on a sidewall of said corresponding cover for mating engagement with said cover mounting protrusions.

4. The ceiling fan kit according to claim 2 further comprising:

at least one cover mounting passage on each of said covers; and at least one protrusion located on a sidewall of said body for mating engagement with said at least one cover mounting passages.

5. The ceiling fan kit according to claim 2 further comprising:

a motor body surrounding said motor; and an upper cage at least partially surrounding said motor body.

6. The ceiling fan kit according to claim 2 further comprising:

a lower cage affixed to said hub body.

7. The ceiling fan kit according to claim 2 wherein:

said fan blades are adapted to be attached to said motor.

8. The ceiling fan kit according to claim 1 further comprising:

an upper cage at least partially surrounding said motor, a lower cage adapted to be affixed to said hub body wherein:

the upper cage and lower cage are adapted to be positioned to form an opening between said upper cage and said lower cage, wherein said fan blades extend through said opening.

9. A ceiling fan kit comprising:

a downrod adapted to be suspended from a ceiling;

a plurality of fan blades adapted to be mounted for rotation about the downrod;

a hub body adapted to be mounted to the downrod and defining a downward facing opening; and a cover adapted to attach to the hub body and be self-supported from the opening.

10. The kit of claim 9 comprising:

a light fixture adapted to be mounted in the opening; and a light cover adapted to attach to the hub body and be self-supported from the opening, wherein the light cover is at least translucent.

11. The kit of claim 9, wherein the hub body comprises a hub canister defining the opening and the hub canister and the covers are adapted to matingly connect, such that the cover is self-supported from the opening.

12. A cover for use with a ceiling fan, wherein the ceiling fan comprises:

a hub body comprising a hub canister defining a downward opening, wherein the hub canister comprises one or more cover-engagement members proximate the opening, and wherein the cover comprises:

a side; and one or more hub-engagement members formed in the side, wherein the hub-engagement members are adapted to engage the cover-engagement members, such that the cover is self-supported from the hub canister.

13. The cover of claim 12, wherein the cover is at least translucent, whereby light may pass through the cover.

14. A light kit adapted for use with a ceiling fan, wherein the ceiling fan comprises a hub body comprising a hub canister defining a downward opening, wherein the hub canister comprises one or more cover-engagement members proximate the opening, wherein the kit comprises:

a light source adapted to mount to the hub body and be contained in the opening; and a light cover comprising a side, wherein the side comprises one or more hub-engagement members adapted to engage the one or more cover-engagement members, such that the cover is self-supported from the hub canister and positioned to cover the opening.

15. A method of manufacturing a ceiling fan adapted to be converted from a lighted mode to an unlighted mode, the method comprising:

providing a hub body adapted to be suspended from a ceiling;

forming a downward opening on the hub body such that the downward opening opens downward when the hub body is operationally suspended;

mounting a light socket in the downward opening;

forming one or more cover-engagements in the hub body proximate the downward opening;

providing a light cover adapted to cover the downward opening, wherein the light cover comprises one or more hub-engagements adapted to detachably engage the ore or more cover-engagements such that the light cover covers the downward opening when the light cover engages the hub body; and forming a hub cover adapted to cover the downward opening, wherein the hub cover comprises one or more hub-engagements adapted to detachably engage the one or more cover-engagements such that the hub cover covers the downward opening when the hub cover engages the hub body.

16. The method of claim 15, comprising providing the hub cover along with the hub body and the light cover.

17. The method of claim 15, comprising forming the downward opening from a general circular hub canister.

18. The method of claim 15, comprising:

forming the downward opening from a hub canister; and forming the one or more cover-engagements in the hub canister.

19. A method of manufacturing a ceiling fan adapted to be converted from an unlighted mode to a lighted mode, the method comprising:

providing a hub body adapted to be suspended from a ceiling;

forming a downward opening on the hub body such that the downward opening opens downward when the hub body is operationally suspended;

providing electrical connections in the downward opening and adapting the downward opening to receive a light socket;

forming one or more cover-engagements in the hub body proximate to the downward opening; and providing a hub cover adapted to cover the downward opening, wherein the hub cover comprises one or more hub-engagements adapted to detachably engage the one or more cover-engagements such that the hub cover covers the downward opening when the hub cover engages the hub body.

20. The method of claim 19, comprising forming a light cover adapted to cover the downward opening, wherein the light cover comprises one or more hub-engagements adapted to detachably engage the one or more cover-engagements such that the light cover covers the downward opening when the light cover engages the hub body.

21. The method of claim 20, comprising:

providing a light socket adapted to be received in the downward opening and connected to the electrical connections;

providing the light cover; and allowing an end user to mount the light socket in the downward opening and cover the downward opening with the light cover.

22. The method of claim 20, comprising:

mounting a light socket in the downward opening connecting the light socket to the electrical connections; and allowing an end user to install a light source in the light socket and cover the downward opening with the light cover.

23. A ceiling fan adapted to be easily converted between an unlighted mode and a lighted mode by an end user, the fan comprising:

a hub body adapted to be suspended from a ceiling the hub body defines a downward opening and one or more cover-engagements;

a plurality of fan blades operationally mounted for rotation relative to the hub body;

a light socket positioned the downward opening; and a cover selected from a group consisting of a light cover comprising one or more hub-engagements adapted to detachably engage the one or more cover-engagements, and a hub cover comprising one or more hub-engagements adapted to detachably engage the one or more cover-engagements, wherein the end user is enabled to attach the selected cover to the hub body such that the cover covers the downward opening.

24. The fan of claim 23, wherein the hub body comprises a hub canister defining the downward opening and the one or more cover-engagements comprise one or more protrusion extending from the hub canister into the downward opening.

25. The fan of claim 24, wherein the one or more hub-engagements of the selected cover comprise one or more channels adapted to detachably engage the one or more protrusions.

26. A ceiling fan kit adapted to be easily converted between lighted and unlighted modes, the kit comprising:

a hub body adapted to be suspended from a ceiling, wherein:

the hub body defines a downward opening adapted to receive a light socket, and the hub body comprises one or more cover-engagements associated with the downward opening;

the kit further comprising:

a plurality of fan blades adapted to be mounted for rotation relative to the hub body; and a hub cover comprising one or more hub-engagements adapted to detachably engage the one or more cover-engagements, wherein the hub cover covers the downward opening when the hub cover engages the hub body.

27. The kit of claim 26, comprising:

a light socket mounted in the downward opening; and a light cover comprising one or more hub-engagements adapted to detachably engage the one or more cover-engagements, wherein the light cover covers the downward opening when the light cover engages the hub body.

28. The kit of claim 27, wherein:

the cover-engagements comprise one or more protrusions extending into the downward opening; and the light cover hub engagements comprise one or more channels adapted to detachably engage the one or more protrusions.

29. The kit of claim 26, wherein:

the cover-engagements comprise one or more protrusions extending into the downward opening; and the hub cover hub-engagements comprises one or more channels adapted to detachably engage the one or more protrusions.

30. A light kit adapted from use with the ceiling fan kit of claim 26, wherein the light kit comprises:

a light socket adapted to be mounted in the downward opening; and a light cover comprising one or more hub-engagements adapted to detachably engage the one or more cover-engagements, wherein the light cover covers the downward opening when the light cover engages the hub body.

31. A light cover adapted for use with the ceiling fan kit of claim 30, the light cover comprising:

a cover adapted to cover the downward opening when the light cover engages the hub body;

one or more sides extending upward from the cover; and one or more hub-engagements formed in the one or more sides and adapted to detachably engage the one or more cover-engagements, wherein the light cover is self-supported from the hub body when the hub-engagements are engaged with the cover-engagements.

32. The light cover of claim 31, wherein the hub-engagements comprises channels adapted to detachably engage the cover-engagements.

33. A ceiling fan comprising:

a hub body adapted to be supported from a ceiling, wherein the hub body defines a downward opening;

a plurality of fan blades mounted for rotation about the hub body;

a light socket operationally mounted in the downward and is adapted opening to emit light downward when a light source is installed in the light socket; and a cover detachably attached to the hub body and covering the downward opening, wherein the cover is non-translucent.

34. A ceiling fan comprising:

a hub body adapted to be supported from a ceiling and defining an opening for containing a light socket;

a plurality of fan blades mounted for rotation about the hub body;

a light socket mounted in the opening; and means for:

covering the opening, and enabling conversion between a lighted mode and an unlighted mode without removing the light socket, wherein the light socket is concealed at least in the unlighted mode.

35. A ceiling fan comprising:

a hub body adapted to be supported from a ceiling;

a plurality of fan blades mounted for rotation about the hub body;

a light socket mounted to the hub body; and means for enabling conversion between a lighted mode and an unlighted mode without removing the light socket, wherein the light socket is concealed at least in the unlighted mode.

36. The ceiling fan of claim 35, wherein the light socket is visible in the lighted mode.

* * * * *

UNITED STATES PATENT AND TRADEMARK OFFICE

CERTIFICATE OF CORRECTION

PATENT NO. : 6,517,316 B1 
DATED : February 11, 2003
INVENTOR(S) : Mark Gajewski It is certified that error appears in the above-identified patent and that said Letters Patent is hereby corrected as shown below:

Title page,
Item [62], replace "May 1, 1999" with -- May 10, 1999 --

Column 5,
Line 21, replace "ore" with -- one --

Signed and Sealed this

Sixteenth Day of September, 2003

JAMES E. ROGAN
*Director of the United States Patent and Trademark Office*